US005325547A

United States Patent [19]

Pino

[11] Patent Number: 5,325,547

[45] Date of Patent: Jul. 5, 1994

[54] WATER CLOSET TANK FLUSH VALVE

[76] Inventor: Wilton J. Pino, 922 Sharp Rd., Baton Rouge, La. 70815

[21] Appl. No.: 1,042

[22] Filed: Jan. 6, 1993

[51] Int. Cl.[5] ..... E03D 1/34

[52] U.S. Cl. ..... 4/378; 4/415

[58] Field of Search ..... 4/327, 378, 415, 324, 4/325, 402–404, 392, 393, 387, 326

[56] References Cited

U.S. PATENT DOCUMENTS

| | | | |
|---|---|---|---|
| 2,940,084 | 6/1960 | Fabbi et al. | 4/327 |
| 3,049,721 | 8/1962 | Taylor | 4/327 X |
| 3,939,507 | 2/1976 | Clark | 4/327 |
| 4,106,136 | 8/1978 | Lippincott | 4/378 X |
| 4,122,564 | 10/1978 | Addicks et al. | 4/415 X |
| 4,984,312 | 1/1991 | Pickerrell et al. | 4/378 |
| 5,195,190 | 3/1993 | Nguyen-Huu | 4/415 X |
| 5,218,725 | 6/1993 | Lipman | 4/393 X |

OTHER PUBLICATIONS

Eljer Industries-Sales Brochure entitled "Beautiful Reasons to Save Water", p. 2.

*Primary Examiner*—Charles E. Phillips

*Attorney, Agent, or Firm*—William David Kiesel; Robert C. Tucker; Warner J. Delaune, Jr.

[57] ABSTRACT

A flush valve extension assembly retrofittable to a conventional water closet is disclosed which comprises a tube having a shoulder member extending outward from the outer surface of the tube in a position to form an upper section of the first tube having a predetermined length and to form a lower section of the tube which can extend into the flush valve seat, the shoulder member being sized to seat on the valve seat; a gasket fittable about the outer surface of the lower section in a position to form a water tight seal between the shoulder member and the flush valve seat; and a means fixable to the tube and extending about the overflow tube in a manner to attach the tube to the flush valve.

5 Claims, 4 Drawing Sheets

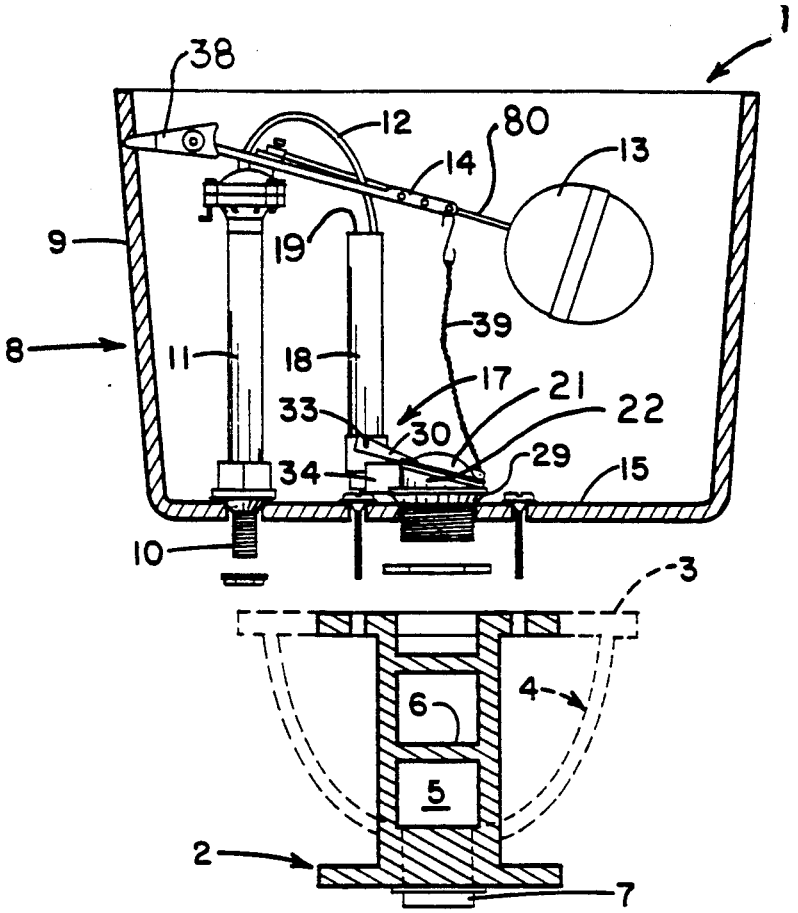
FIGURE 1 - PRIOR ART
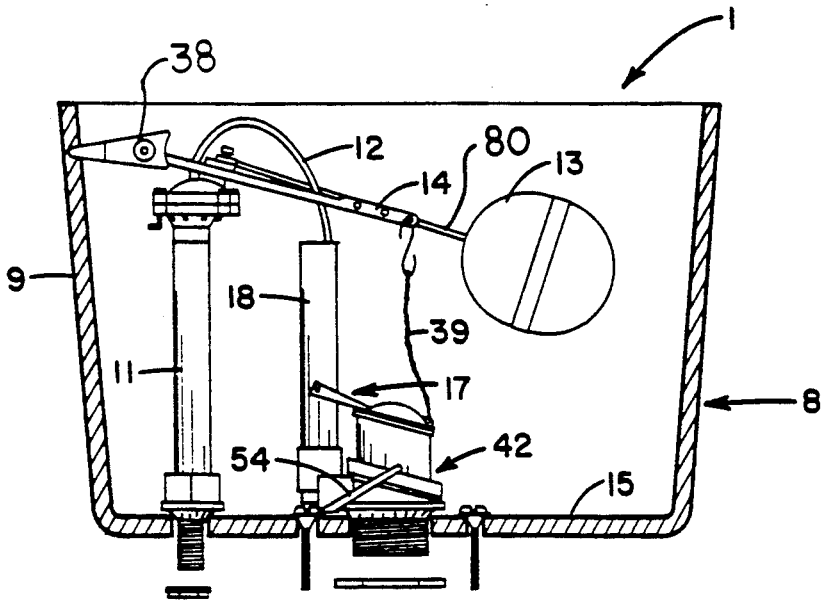
FIGURE 2

WATER CLOSET TANK FLUSH VALVE

BACKGROUND OF THE INVENTION

1. Field of the Invention

This invention relates in general to water closets, and more particularly, to flush valve extension assemblies retrofitable to existing flush valves used in water closets.

2. Prior Art

There has been a growing concern over the amount of water used by conventional water closets. This concern has been prompted in some geographical areas by the shortage of available water. In other areas the cost of treating municipal waste water before it can be recycled to a stream, lake or other water reservoir has prompted an examination into ways to minimize the amount of waste water that must be treated.

As a result of this concern many new water closet designs are now available which utilize substantially less water as the older designs. One example of the new designs is the Eljer "Ultra-One/G" which utilizes a tank trim to meter the amount of water that passes from the tank to the bowl during flushing. Other designs utilize tanks of less capacity and redesign the tank, flush valve and bowl system to create sufficient hydraulics to allow the water closet to properly discharge the waste and water in the bowl during flushing.

However, none of these solutions can be incorporated into the millions of existing water closets. Therefore, there is a serious need in the bathroom plumbing industry for an inexpensive device that can be quickly and easily fitted to existing water closets that will allow the use of less water when discharging the waste and water in the water closet bowl during flushing.

OBJECTS AND SUMMARY OF THE INVENTION

Therefore one object of this invention is to provide a device that can be retrofitted to existing conventional water closets that will allow the use of less water when discharging the waste and water in the water closet bowl during flushing.

Another object of this invention is to provide a device that can be quickly and easily retrofitted to existing conventional water closets which permits the use of substantially less water during flushing.

Still another object of this invention is to provide a device of simple and inexpensive construction which can be retrofitted to existing conventional water closets which permits the use of substantially less water during flushing.

These and other objects and advantages of the invention will become apparent from the ensuing descriptions of the invention.

Accordingly, a flush valve extension assembly for use in a water closet having a tank for holding water to be conveyed through a drain tube to a bowl by activation of a flush valve during flushing, which flush valve is fixed at one end to the drain tube and is provided with a valve seat at its opposite end on which a flexible seal that is pivotly attached to an overflow tube positioned in the tank can be seated, is provided comprising a tube having a shoulder member extending outward from the outer surface of the tube in a position to form an upper section of the first tube having a predetermined length and to form a lower section of the tube which can extend into the flush valve seat, the shoulder member being sized to seat on the valve seat; a gasket fitable about the outer surface of the lower section in a position to form a water tight seal between the shoulder member and the flush valve seat; and a means fixable to the tube and extending about the overflow tube in a manner to attach the tube to the flush valve.

BRIEF DESCRIPTION OF THE DRAWINGS

FIG. 1 is a cross-sectional view of a conventional prior art water closet illustrating the internal features of its tank into which is positioned its flush valve.

FIG. 2 is a cross-sectional view of the water closet of FIG. 1 with a preferred embodiment of the flush valve extension assembly of this invention retrofitted to the flush valve.

PREFERRED EMBODIMENTS OF THE INVENTION

Figure 3:
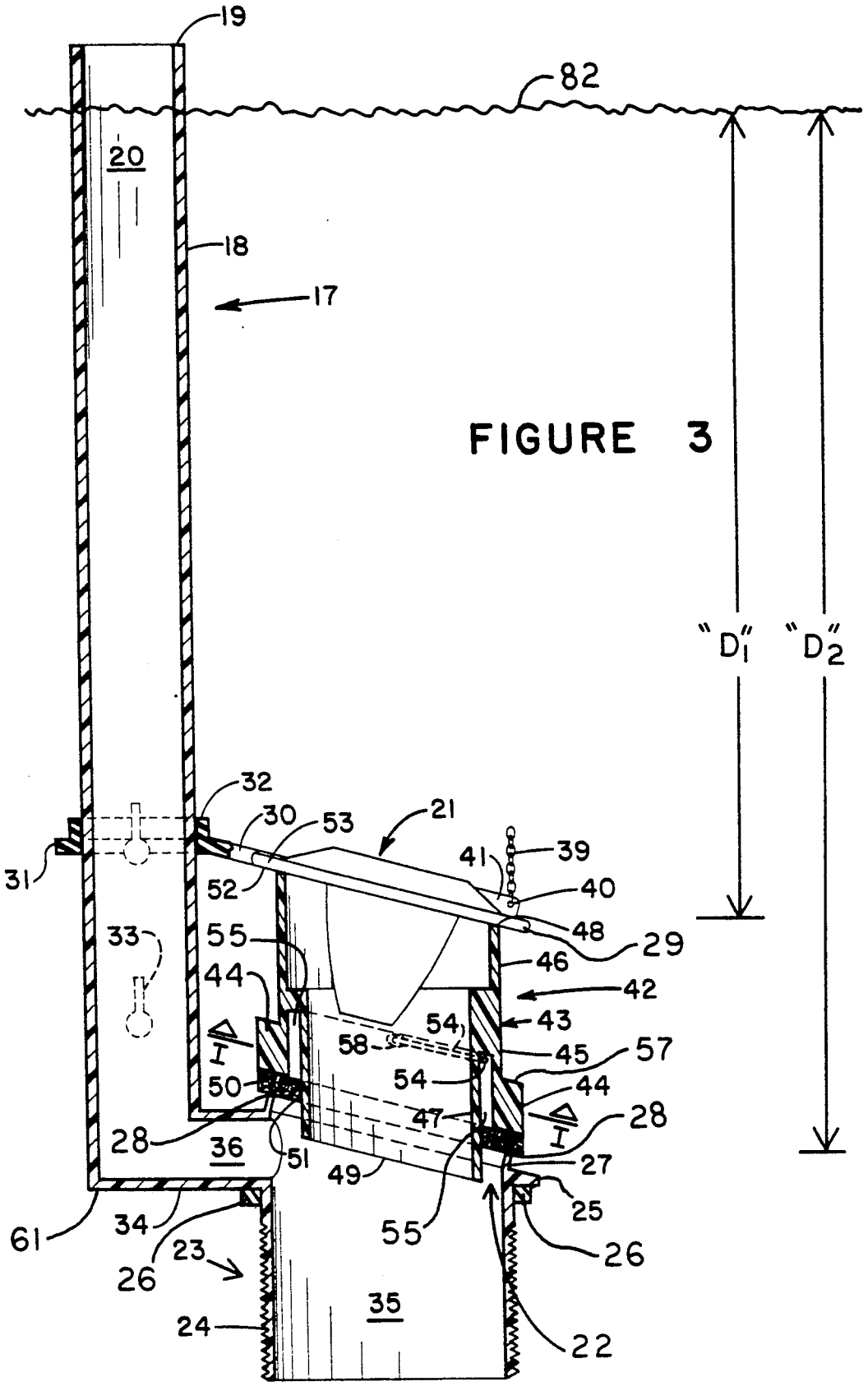
FIG. 3 is a partial cross-sectional view of the overflow tube to which one preferred embodiment of the flush valve extension assembly of this invention has been attached.

In a conventional water closet construction as illustrated in FIG. 1, the water closet, denoted generally by the numeral 1, comprises a lower pedestal structure 2 having a seat 3 defining the top area of a bowl 4. Bowl 4 is shaped to hold water and waste material until bowl 4 is flooded with a sufficient amount of water to cause the waste material to pass through bowl exit passageway 5 and into toilet bend pipe 6 from where it passes to piping 7 leading to outside sewerage lines (not shown).

Operatively attached to pedestal structure 2 is tank assembly 8 comprising a tank 9 shaped to hold a predetermined minimum amount of water. In a conventional arrangement water is introduced into tank 9 from an exterior water line 10. The water flows from line be through a ballcock valve 11, and into tank 9. The amount of water in tank 9 is controlled by a float ball 13 operatively attached to ballcock valve 11. As tank 9 fills with water, float ball 13 will begin to rise. This rising action will cause float-bal arm 80 to actuate the valve closing mechanism of ballcock valve 11. Thus by setting the position when the float ball 13 will actuate the valve closing mechanism one can control the amount of water which will flow through ballcock valve 11, and hence the amount of water in tank 9.

Figure 4:
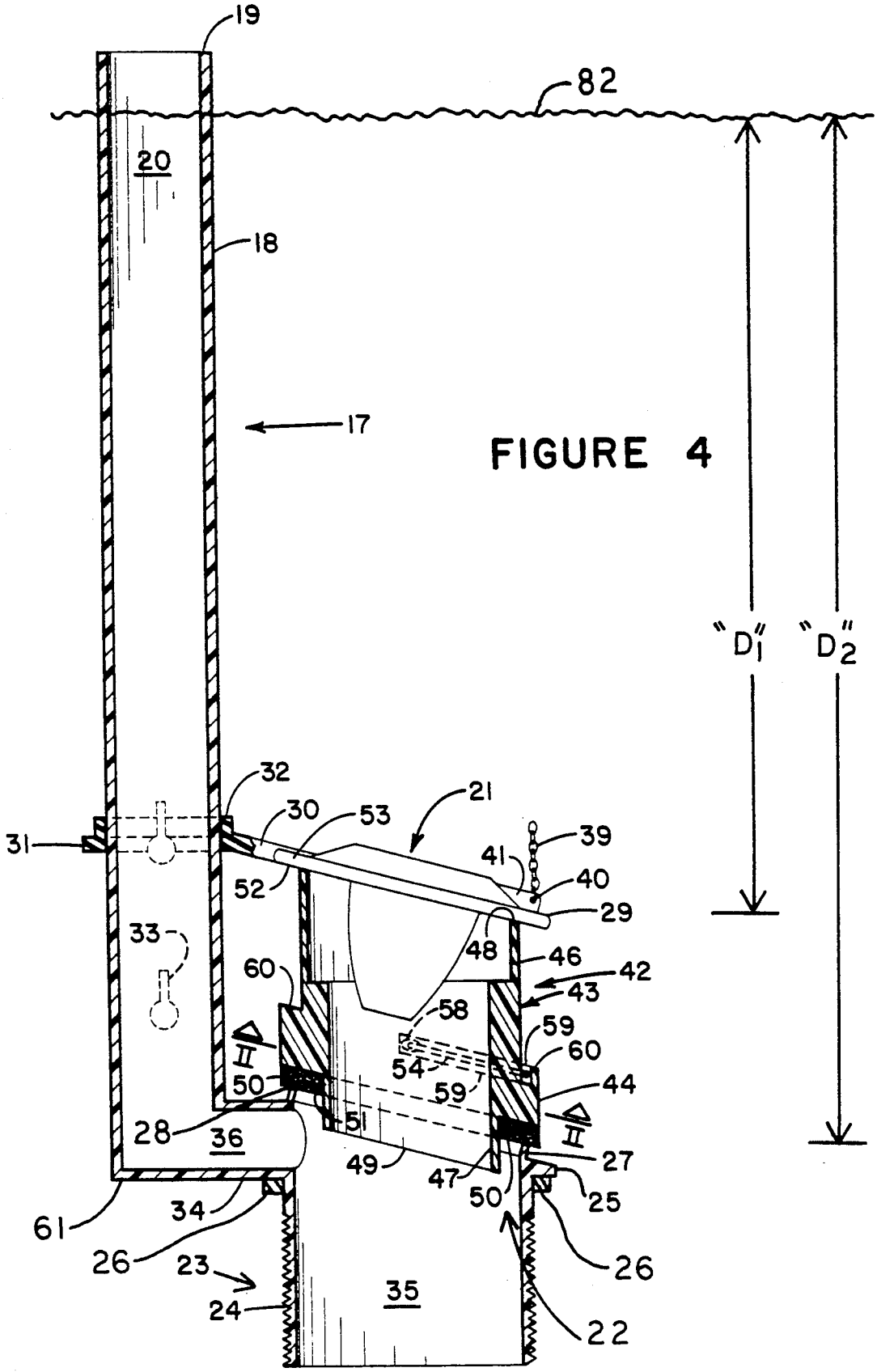
FIG. 4 is a partial cross-sectional view of the overflow tube to which another preferred embodiment of the flush valve extension assembly of this invention has been attached.

The bottom wall 15 of tank 9 is provided with a threaded opening 16 into which a flush valve/overflow tube assembly 17 fits in a manner to seal opening 16. In a conventional structure assembly 17 comprises an overflow tube 18 that extends perpendicularly upward from bottom wall 15. With reference to FIGS. 3 and 4, the top edge 19 of overflow tube 18 extends somewhat above the desired level 82 of water in tank 9. In this manner if the level of water reaches undesirable levels the water will flow into and down overflow tube passageway 20. Assembly 17 also comprises flush valve 21 and flush valve seating structure.

Seating structure 22 comprises a drain tube 23 having a lower threaded section 24 which can be screwed into threaded opening as shown in FIGS. 1 and 2. Drain tube 23 is also provided with a lip section 25 extending perpendicularly outward from the lower threaded section 24. It is preferred that a sealing gasket 26 be positioned below lip section 25 and around lower threaded section 24 to better seal opening 16 when drain tube 23 is screwed into opening 16. Drain tube 23 is further provided with an valve seat 27 which has a top edge 28 that is angled to assist flush valve 21 in seating on top edge 28.

Flush valve 21 is generally constructed from rubber or other similar resilient material to facilitate forming a seal when seated on top edge 28. Flush valve 21 consists of sealing member seating arm(s) 30 and attaching ring 31. Attaching ring 31 fits about overflow tube 18 and is positioned so that sealing member will naturally rest on top edge 28. Seating arm(s) 30 will be constructed of sufficiently flexible material to allow sealing member 29 to be lifted from top edge 28 when lever arm 14 moves upward.

Assembly 17 also comprises duct 34 which connects overflow tube passageway 20 with tubular section passageway 35. In this configuration water which flows down overflow tube passageway 20 passes through duct passageway down through tubular section passageway 35, and then to bowl 4.

Thus, in a conventional water closet, water enters tank 9 through ballcock valve 11 which is connected to a water source (not shown). Gravity positions the extension assembly 42 on top edge 28 of seating section 27. Water pressure formed by the rising level of water in tank 9 forces the flush valve 21 against top edge 48 forming a seal. At a predetermined height, water in tank 9 contacts float ball 13 and cause it to ascend. The ascending action of float ball 13 actuates ballcock valve 11. When float ball 13 reaches a certain height ballcock valve 11 will close, and no further water will enter tank 9. In this manner the amount of water in tank 9 can be controlled.

To flush the water closet trip lever 38 operatively connected to lever arm 14 causes lever arm 14 to be raised. Lever arm 14 is connected by pull chain 39 to eyelet 40 of shoulder ridge 41 protruding from flush valve 21. Because flush valve 21 is pivotly connected at one side of its perimeter, by seating arm(s) 30, to overflow tube 18 it will rise up from top edge 48. Once flush valve 21 rises from top edge 48, water will immediately flow from tank 9 to bowl 4. This sudden filling of bowl 4 results in the flushing of the waste material in bowl 4 through bowl exit passageway 5 and into the sewer line (not shown).

Turning now to FIGS. 2 and 3, flush valve extension assembly 42 of this invention is illustrated as applied to the conventional water closet as shown in FIG. 1 and described above. In the most preferred embodiment extension assembly 42 comprises a tube 43 having a shoulder member 44 extending outward from the outer surface 45 of extension tube 43 to form an upper section 46 of predetermined length and a lower section 47 which extends into tubular section passageway 35. Upper section 46 will extend upward into tank 9 to define a predetermined volume in tank 9 between the top edge 48 of upper section 46 and the maximum water level permitted in tank 9. This volume will be less than the normal volume of water contained in tank 9 and available for flushing.

It is preferred that the cross-sectional area of lower section opening 49 be sized to maximize the flow velocity of water through tubular section passageway 35 during the flushing procedure. This cross-sectional area is a function of the depth of water in tank 9 prior to flushing, as well as the cross-sectional area of passageway 35. In a more preferred embodiment upper section 46 is of a length sufficient to allow the lowest part of top edge 48 to be positioned, when said assembly is operatively fixed to said overflow valve, so that the distance "$D_1$", between the lowest part of top edge 48 and the maximum operative water level 82 in tank 9 is 30%-60% of the distance "$D_2$", between top edge 28 of seating section 27 and the maximum operative water level 82. More preferably, the interior cross-sectional area of lower section 47 is at least 30% less than the interior cross-sectional area of passageway 35.

Extension assembly 42 also comprises a gasket 50 fittable about-the outer surface 51 of lower section 47 in a position to form a water tight seal between top edge 28 of seating section 27 and shoulder member 44. To force extension assembly 42 in sealing relationship with flush valve seating structure 22 a means, such as strap 54 attachable to extension tube 43 and overflow tube 18 in a manner to hold extension tube 43 and overflow tube 18 fixedly in position, is employed. Alternate preferred methods of attaching strap 54 to extension tube 43 are illustrated in FIGS. 3, 5 and FIGS. 4,6.

Figure 5:
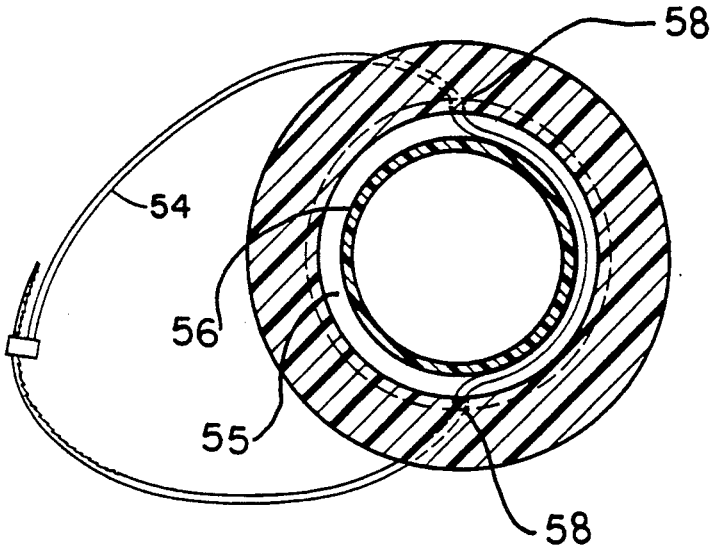
FIG. 5 is a cross-sectional view taken along lines I—I of FIG. 3 illustrating one preferred embodiment for attaching a securing strap used to secure the flush valve extension to the overflow tube.

In FIGS. 3 and 5, extension tube 43 is constructed to provide concentric with passageway 35, a channel 55 extending at least partially, or as shown, completely around lower section 47. At opposite sides of outer surface 45 of upper section 43, but positioned above the upper surface 57 of shoulder member 44, are openings 58 sized to permit strap 54 to pass through.

Figure 6:
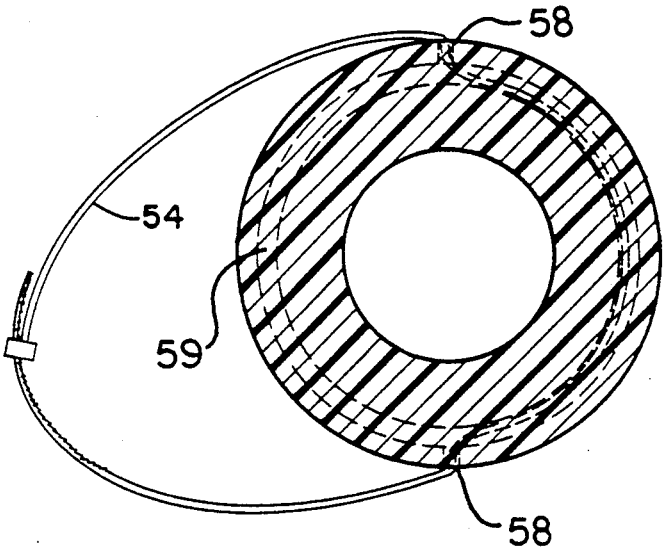
FIG. 6 is a cross-sectional view taken along lines II—II of FIG. 4 illustrating another preferred embodiment for attaching a securing strap used to secure the flush valve extension to the overflow tube.

In FIGS. 4 and 6, extension tube 43 is constructed to provide concentric with passageway 35, a channel 59 formed in top surface 60 of shoulder member 44. Channel 59 may extend partially or completely around extension tube 43. As in the previous embodiment openings 58 are provided to allow strap 54 to exit channel 59.

In both configurations straps 54 are looped under bottom surface 61 of duct 34 (See FIG. 2), and then connected to one another in any conventional fashion to force extension tube 43 down toward valve seat 27 to effect the desired seal.

Figure 7:
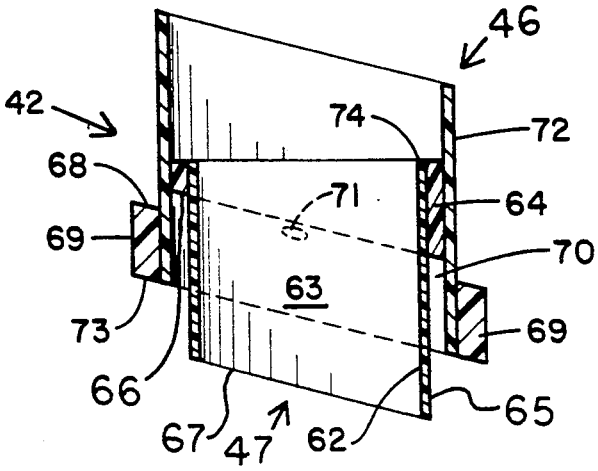
FIG. 7 is a cross-sectional view of an alternate preferred embodiment of the flush valve extension tube of this invention.

In a third alternate preferred embodiment of flush valve extension assembly 42 construction can be simplified by gluing, otherwise similarly fixing, concentric tubes of varying length as shown in FIG. 7. In this embodiment lower section 47 is formed by inner tube 62 having a passageway 63 of desired cross-sectional area. Spacer tube 64 having an interior shape to sealing fit about the outer surface 65 of inner tube 62. The lower edge 66 of spacer tube 64 will be positioned above both the lower edge 67 of inner tube 62 and the upper surface 68 of outer shoulder section tube 69 to permit the formation of gap channel 70 and strap openings 71. Finally, upper section 46 is formed by outer tube 72 that extends from the bottom edge 73 of shoulder section tube 69 upward above the top edge 74 of inner tube 62. In each case tubes and 69 are shaped to allow them to be glued together to form an unitary unit. The configuration in FIG. 4 could also be formed in similar fashion from a series of concentric tubes of varying lengths.

The flush valve extension assembly 42 can easily and quickly be attached to existing conventional flush valve assemblies. One first moves attaching ring 31 upward on overflow tube 18 to the desired position. Next one places gasket 50 about lower section 47, and then positions assembly 42 on valve seat 27. Strap 54 is then fitted about bottom surface 61 of duct 34 and tightened to form the desired seal between shoulder member 44 and valve seat 27. Finally, chain 39 is adjusted for the decreased distance between eyelet 40 and lever arm 14.

There are of course other alternate embodiments which are obvious from the foregoing descriptions of the invention which are intended to be included within the scope of the invention as defined by the following claims.

What I claim is:

1. A flush valve extension assembly for use in a water closet having a tank for holding water to be conveyed through a drain tube to a bowl by activation of an existing flush valve having a flexible flush valve member adapted to seat on an existing valve seat on said drain tube, said flexible flush valve member being pivotally attached to an overflow tube positioned in the tank, said flush valve extension assembly comprising:

(a) a tube assembly having formed therein a channel for receiving a flexible strap member, said assembly including a shoulder member extending outward from an outer surface of said tube assembly in a position to divide said tube assembly into an upper section above said shoulder member, and a lower section below said shoulder member, said upper section being of a predetermined length and having a valve seat formed at the upper end thereof, said lower section being dimensioned to be received within said existing drain tube so as to allow said shoulder member to seat on said existing valve seat;

(b) a gasket fittable about the outer surface of said lower section in a position to form a water tight seal between said shoulder member and said existing flush valve seat; and (c) a flexible strap having opposite ends connectable to one another in a plurality of selectable positions so as to form a loop, said loop having a portion thereof confined in said channel and a portion thereof extending around said overflow tube in order to retain said tube assembly on said drain tube.

2. A flush valve extension assembly according to claim 1 wherein said tube assembly comprises:

(i) a first tubular member forming said upper section, and having a seat opening in the upper portion of said upper section sized to allow a portion of said existing flexible flush valve member to seat on said seat opening, and having an inner diameter sized to permit said portion of said existing flexible flush valve member, when seated on said seat opening, to seal said seat opening;

(ii) a second tubular member forming said lower section, and having an outer diameter less than the inner diameter of said first tubular member, said second tubular member extending partially into said first tubular member; and (iii) a spacer tube positioned between said first tubular member and said second tubular member so as to form a seal between said first tubular member and said second tubular member.

3. A flush valve extension assembly according to claim 2 wherein said shoulder member is a third tubular member having an inside diameter equal to the exterior diameter of said first tubular member to permit said third tubular member to fit over said first tubular member and be fixed at said position.

4. A flush valve extension assembly according to claim 2 wherein:

(a) said upper section is of a length sufficient to allow said seat opening to be positioned when said assembly is operatively fixed to said overflow valve so that the distance between said seat opening and the maximum operative water level in said tank is 30%–60% of the distance between said valve seat and said water level, and (b) the interior cross-sectional area of said second tubular member is at least 30% less than the interior cross-sectional area of said drain tube.

5. A flush valve extension assembly according to claim 2 wherein:

(a) said first tubular member, said second tubular member and said spacer tube are positioned relative to one another to form said channel between said first tubular member and said second tubular member which extends about the perimeter of said second tubular member at a position above said shoulder member, and (b) said first tubular member has two openings positioned above said shoulder member and extending into said channel, each of said openings being of sufficient size to permit said flexible strap to pass through each of said openings.

* * * * *